US011484138B2

(12) United States Patent
Smith et al.

(10) Patent No.: US 11,484,138 B2
(45) Date of Patent: Nov. 1, 2022

(54) EXTENDABLE AND RETRACTABLE INSULATED BEVERAGE HOLDER

(71) Applicants: Bryan Andrew Smith, Midland, MI (US); Aaron Richard Hick, Midland, MI (US)

(72) Inventors: Bryan Andrew Smith, Midland, MI (US); Aaron Richard Hick, Midland, MI (US)

( * ) Notice: Subject to any disclaimer, the term of this patent is extended or adjusted under 35 U.S.C. 154(b) by 0 days.

(21) Appl. No.: 17/177,128

(22) Filed: Feb. 16, 2021

(65) Prior Publication Data

US 2021/0259446 A1 Aug. 26, 2021

Related U.S. Application Data

(60) Provisional application No. 62/979,052, filed on Feb. 20, 2020.

(51) Int. Cl.
*A47G 23/02* (2006.01)
*B65D 81/38* (2006.01)

(52) U.S. Cl.
CPC .. *A47G 23/0266* (2013.01); *A47G 2023/0291* (2013.01); *B65D 81/3881* (2013.01)

(58) Field of Classification Search
CPC ..... B65D 81/38; B65D 81/3876; B65D 81/3879; B65D 81/3881; B65D 81/3883; B65D 81/3886; B65D 81/3888; B65D 81/389; B65D 81/3893; B65D 81/3895; B65D 81/3897; A47G 23/02; A47G 23/0208; A47G 23/0216; A47G 23/0241; A47G 23/0266; A47G 2023/0275; A47G 2023/0283; A47G 2023/0291
See application file for complete search history.

(56) References Cited

U.S. PATENT DOCUMENTS

| | | | | |
|---|---|---|---|---|
| 9,555,949 | B1 * | 1/2017 | French | B65D 81/3872 |
| 10,030,903 | B2 * | 7/2018 | Nguyen | F25D 3/08 |
| 2002/0162845 | A1 * | 11/2002 | Yeh | A47G 19/2227 220/625 |
| 2005/0061764 | A1 * | 3/2005 | Tamashiro | B65D 7/04 220/666 |
| 2020/0253401 | A1 * | 8/2020 | Haas | A47J 41/024 |

* cited by examiner

*Primary Examiner* — Javier A Pagan

(57) ABSTRACT

An insulated beverage holder device includes an insulated outer hollow cylinder, the insulated outer hollow cylinder including an open top and a bottom floor; an interior insulating hollow cylinder, the interior insulating hollow cylinder having an open top and an open bottom; and an insulating hollow liner, the insulating liner having an open top and an open bottom. The interior insulating hollow cylinder may be configured to be positioned inside the insulated outer hollow cylinder and attached to the insulated outer hollow cylinder. The insulating hollow liner may be attached to the interior insulating hollow cylinder and the insulating hollow liner to touch a first beverage container.

13 Claims, 11 Drawing Sheets

EXTENDABLE AND RETRACTABLE INSULATED BEVERAGE HOLDER

RELATED APPLICATION

This application claims priority to provisional patent application Ser. No. 62/979,052, filed Feb. 20, 2020 and entitled Extendable and Retractable Insulated Beverage Holder, the disclosure of which is hereby incorporated by reference.

BACKGROUND

1. Field of the Invention

The invention relates generally to an extendable and retractable insulated beverage holder

2. Background

There are many single unit drink vessel holding devices but these embodiments fail to meet the need of holding, insulating and utilizing more than one drink vessel. Some other solutions for insulated multiple drink vessel holding devices attempt to help a user carry more than one drink vessel or can, but these solutions also fail to meet the needs of the industry because many of the current embodiments do not allow a user to drink the beverage while it's actually in the device. Still, some other solutions attempt to help a user carry more than one drink vessel or can while the user is able to drink one. However these solutions are similarly unable to meet the needs of the industry, because the second drink can is hard to retrieve and access when needed. Furthermore it only serves as a multiple drink can and lacks an ability to serve one drink can only. Still further, other solutions seek to allow a user access to multiple drinks, but the configurations are of two separate and unique devices that are not connected, but attached and then disconnected thus leaving the user two devices to keep track of. In addition, there is missing unity and strength in this style of configuration.

SUMMARY OF THE INVENTION

It is desirable to have a beverage holder that can be used similarly as traditional devices which only hold one beverage vessel or can, and yet be versatile enough to hold more than one beverage vessel or can in the same device stacked vertically. The stacking of more than one vessel or can allow a user to manage the device with a single hand. Furthermore, it is desirable to keep the drink cans insulated during use in such a device. The disclosed device advantageously fills these needs and addresses the aforementioned deficiencies by providing an extendable and retractable insulated beverage holder which can hold and insulate one or two, vertically stacked, beverage cans or vessels.

Disclosed herein is an extendable and retractable insulated beverage holder, which may be made up of the following core components: 1) an outer insulating hollow cylinder with an open top and a closed or partially closed base; and 2) an inner insulating hollow cylinder with an open top and an open base. In these embodiments, these components may be connected such that the inner cylinder with the open top and open bottom may sit inside the outer cylinder. In these embodiments, the inner cylinder may extend and retract within the outer hollow cylinder. In these embodiments, the insulated beverage holder may have: 1) a retracted position (the inner cylinder is positioned mainly within the outer cylinder), where the insulated beverage holder device holds a single drink vessel; and 2) an extended position (where the inner cylinder is extended past and above a portion of the outer cylinder and where the insulated beverage holder device holds two drink cans vertically stacked, while keeping the cans insulated. In these embodiments, the outer cylinder and the inner cylinder may be connected to each other such that the outer cylinder and the inner cylinder may extend and retract between each other to the desired position or configuration, but do not separate. In an embodiment, the inner hollow cylinder may be connected to the outer hollow cylinder via a track and knob or peg assembly in order to perform functionality, although other assemblies may be utilized to connect the outer cylinder to the inner cylinder.

In some embodiments, the insulated beverage holder device may also include an external shell. In these embodiments, the external shell may fit over or around an outside surface of the outer hollow cylinder. In these embodiments, the external shell may serve the purpose of, but not limited to adding customization, additional ergonomics for holding, and/or adding another insulating layer to the insulated beverage holder device. In these embodiments, a thickness of the external shell may be less than ¼ inch thick, or may also range from $1/32^{th}$ inch to ¾th inch thin. In these embodiments, the external shell may encompass most of a height of the external side walls of the outer hollow cylinder and/or also may cover and/or encompass the bottom of the outer hollow cylinder. In these embodiments, the external shell should not interfere with the extend and retract functionality of the inner cylinder. In these embodiments, the external shell may preferably be made out of a material such as but not limited to plastic, foam, rubber, wood, metal or fabric. Furthermore, by having the external shell, a thickness of the outer hollow cylinder may be varied depending on desired aesthetic and insulation performance desired, i.e., if the device does not include an external shell, the thickness of the outer hollow cylinder may have to be increased and vice versa.

In some embodiments, another optional feature of the insulated beverage holder device is an insulating inner liner or sleeve. In these embodiments, the insulated beverage holder or sleeve may be attached to an inside surface and/or side of the inner hollow cylinder to add additional features, such as but not limited to, increased insulation and device performance. These factors add additional functionality and benefits to the invention but do not hinder the basis of the device's functions and performance of an insulated beverage holder device that relates to an extendable and retractable insulating drink container designed to vertically stack one or two drinking vessels such as, but not limited to, a twelve ounce beverage can.

The disclosed insulated beverage holder device is unique when compared with other known devices and solutions because it: (1) allows a user to vertically hold and insulate one or two beverage vessels or cans, such as a 12 ounce can (2) the embodiment intuitively and easily allows a user to switch between the insulated beverage holder device being able to hold one or two cans; (3) stores and insulates one or two drink vessels, such as 12 ounce cans, while the user can drink from a second can all within the same insulating device; and (4) when not in two can vertically stack mode, the beverage holder device adjusts and fully insulates single cans of different heights such as standard 12 oz, 16 oz or 19 oz cans.

The disclosed insulated beverage holder device is unique in that the insulating device is structurally different from other known devices or solutions. More specifically, the insulated beverage holder device is unique due to the presence of (1) two insulating connected cylinders (an outer cylinder and an inner cylinder) that extend and retract allowing for versatility between one drink vessel or cans of varying heights and/or two drink vessels within the same embodiment while providing insulation to the vessels; (2) and the optional outer shell which adds further benefits such as but not limited to aesthetic customization, increased insulation properties and/or ergonomics.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The Extendable and Retractable Insulated Beverage Holder Device may, however, be embodied in many different forms and should not be construed as being limited to the embodiments set forth herein; rather, these embodiments are provided by way of illustration only and so that this disclosure will be thorough, complete and fully convey understanding to those skilled in the art.

DETAILED DESCRIPTION

The present invention is directed to an extendable and retractable insulated beverage holder. The following detailed description and provides a better understanding of the features and advantages of the inventions described in the present disclosure in accordance with the embodiments disclosed herein. Although the detailed description includes many specific embodiments, these are provided by way of example only and should not be construed as limiting the scope of the inventions disclosed herein.

The claimed subject matter may serve drinking vessels or cans. The phrases drinking vessels, drinking utensils, cans, containers, and drinking containers may be utilized interchangeably throughout the specification. Drinking vessels may include, a standard 12 ounce can like a can of soda, juice or alcohol beverage, but are not limited to this standard 12 ounce can size as the claimed subject matter may be modified to handle different size drinking vessels, where the different sizes may be height, width and/or diameter.

Figure 1:
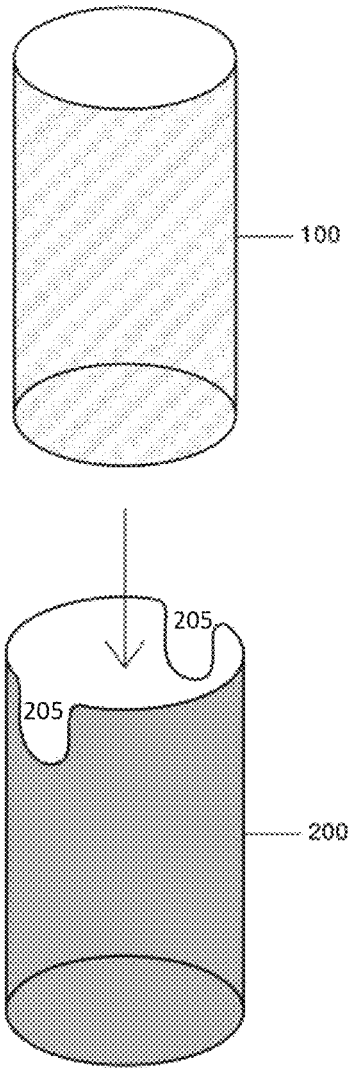
FIG. 1 illustrates an inner insulated hollow cylinder going into outer insulated hollow cylinder according to a first embodiment.

FIG. 1 illustrates an inner insulated hollow cylinder before it goes into outer insulated hollow cylinder according to a first embodiment. In some embodiments, insulating beverage holder device may include an inner insulating hollow cylinder 100 (having an open top and an open bottom) and an outer insulating hollow cylinder device 200 (which has an open top and a bottom surface or floor). In these embodiments, the outer insulating housing cylinder 200 may have one or more cutouts 205. In some embodiments, the one or more cutouts may be U-shaped cutouts.

Figure 2:
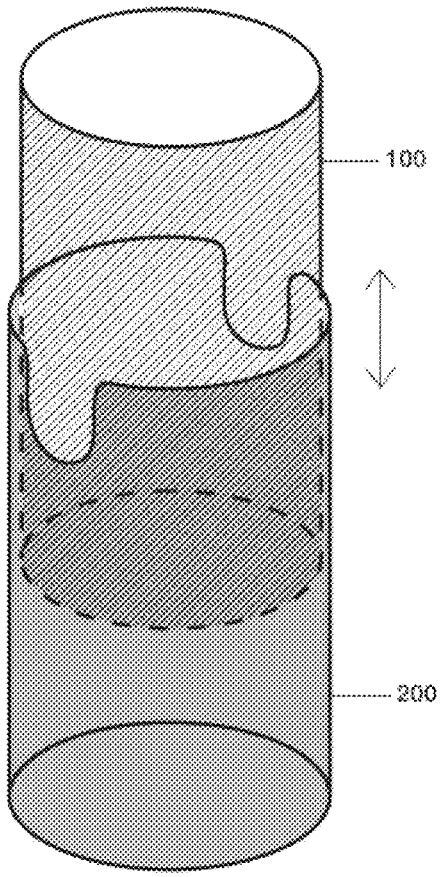
FIG. 2 illustrates the cylinders in their extended form according to a first embodiment.

FIG. 2 illustrates an inner insulated hollow cylinder in a partial extended position according to some embodiments. In this illustration, the inner cylinder 100 is approximately halfway extended with respect to the outer insulating housing cylinder 200. In this embodiment, a tall beverage vessel or can (e.g., 16 oz. or tallboy) may be placed into the insulated beverage holder device and still be insulated.

Figure 3:
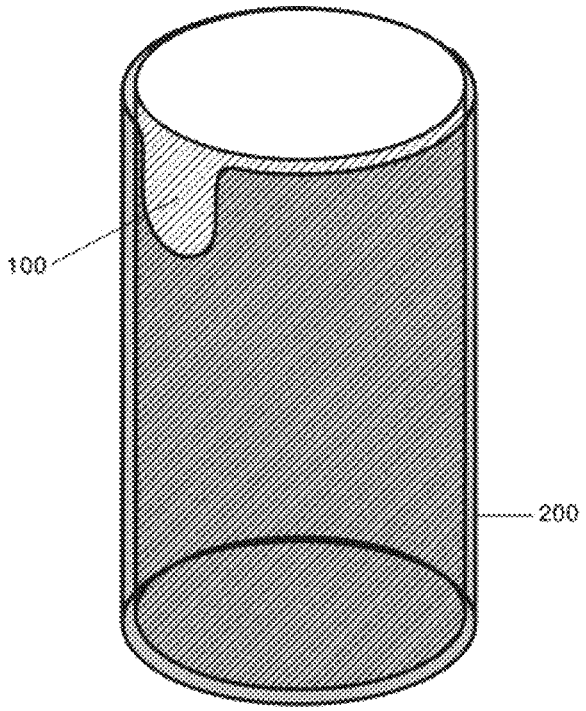
FIG. 3 illustrates the cylinders in their retracted form according to some embodiments.

FIG. 3 illustrates an inner insulated hollow cylinder in a retracted position according to some embodiments. In this illustration, the inner cylinder 100 is positioned inside the outer cylinder 200 or mostly inside the outer cylinder 200. In other words, there may be a portion of the inner cylinder 100 that is not inside the outer cylinder 200.

Figure 4:
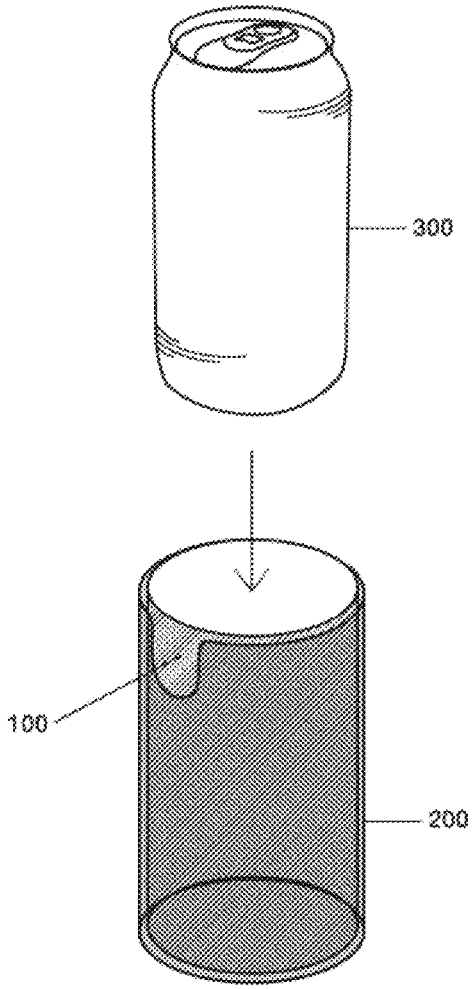
FIG. 4 illustrates an example of a drinking vessel being inserted in the retracted form according to the first embodiment.

FIG. 4 illustrates an example of a drinking vessel or can positioned above the insulated beverage holder device in a retracted position according to the first embodiment.

Figure 5:
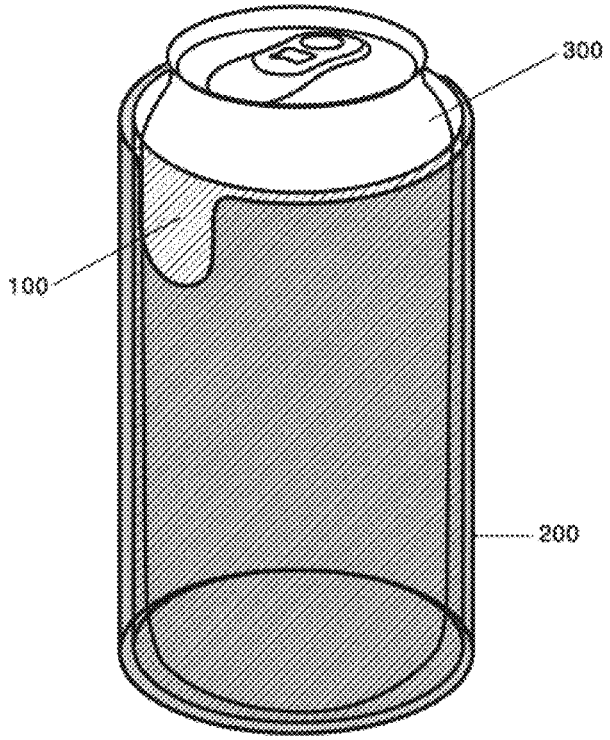
FIG. 5 illustrates a retracted form of the device holding a drinking vessel according to the first embodiment.

FIG. 5 illustrates an example of a drinking vessel or can inserted into the insulated beverage holder device in a retracted position according to the first embodiment. In this illustrated embodiment, the inner insulating hollow cylinder 100 may be positioned in the outer insulating hollow cylinder 200 (and thus be in the retracted position). In this illustrated embodiment, in FIG. 5, the beverage vessel or can is placed or positioned inside the inner cylinder 100 as well as the outer cylinder 200. This may be referred to as a single can or beverage mode or configuration.

Figure 6A:
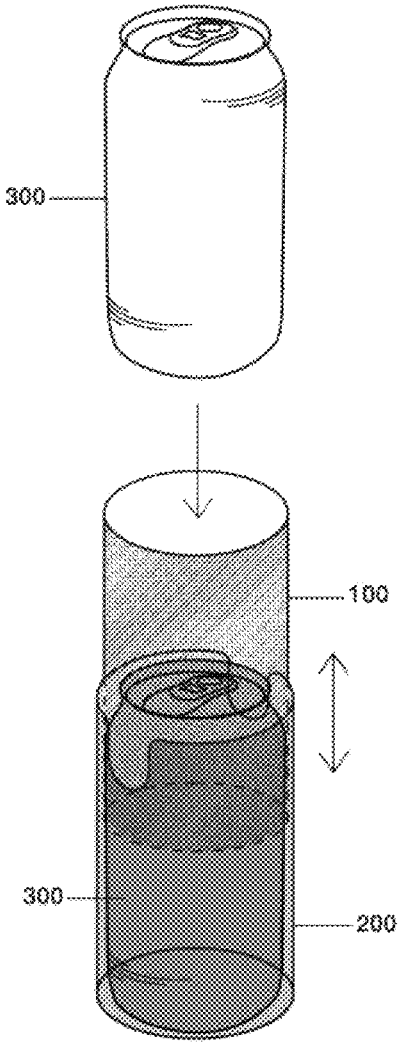
FIG. 6A illustrates an example of a drinking vessel being inserted in extended form with a drinking vessel already in bottom half according to some embodiments.

FIG. 6A Illustrates an example of a second drinking vessel or can positioned above the insulated beverage holder device in an extended position according to the first embodiment.

Figure 6B:
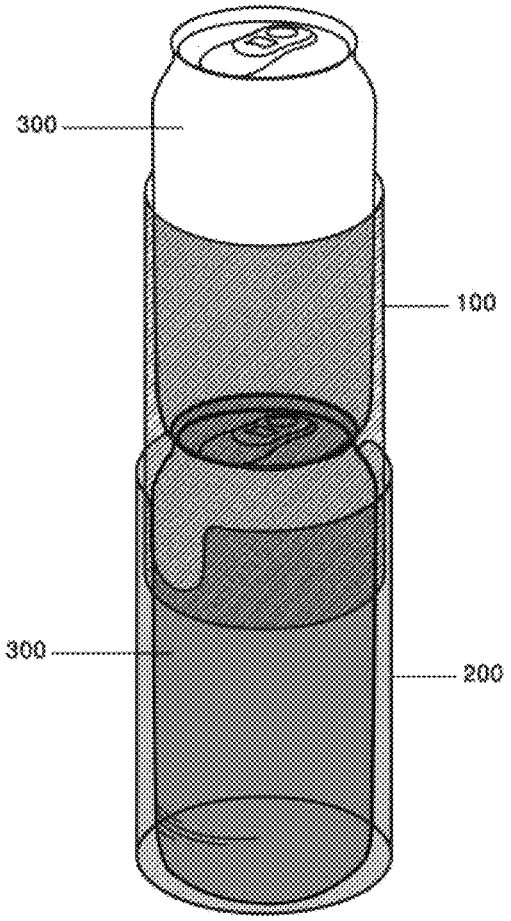
FIG. 6B illustrates an example of a drinking vessel being inserted in extended form with a drinking vessel already in bottom half according to some embodiments

FIG. 6B Illustrates an example of a second drinking vessel or can positioned within at least a portion of the insulated beverage holder device in an extended position according to the first embodiment. In these embodiments, as is illustrated in FIGS. 6A and 6B, the inner cylinder 100 may be in an extended position with respect to the outer cylinder 200. The first beverage can or vessel 300 may be positioned inside a bottom portion of the inner cylinder 100 and also positioned inside the outer cylinder 200. In these embodiments, as illustrated in FIGS. 6A and 6B, a portion of the second can or beverage vessel 300 may be positioned on top of the first can or beverage vessel 300 as well as within a portion of the upper cylinder 100. In some embodiments, 50 percent of the second beverage vessel or can 300 may be surrounded by the inner cylinder 100, or alternatively a range between 30 to 90 percent of the second beverage vessel or can 300 may be surrounded by the inner cylinder 100. In these embodiments, the beverage vessels may be vertically stacked with respect to each other.

The embodiments described herein may hold and insulate drinking vessels or cans, such as but not limited to the standard 12 ounce can like a can of soda, juice or alcohol beverage but would not be limited to this standard 12 ounce can size. In some embodiments, wider or less wide beverage vessels or cans may be supported by increasing a width (or decreasing a width) of the insulated beverage holder device. In some embodiments, taller or shorter beverage vessels may be supported by the insulated beverage holder device.

In some embodiments, the insulated beverage holder device may be made up of the following components: (1) an insulating outer hollow cylinder 200 with an open top and a floor at the bottom; (2) an interior insulating hollow cylinder 100 positioned inside the outer cylinder 200, which has an open top and open bottom; (3) an outer shell (not shown) that covers a portion or most of an exterior of the outer hollow cylinder 200 that has added insulating properties, such as, but not limited to polymer foam; and (4) an inner liner (not shown) with added insulating properties such as, but not limited to, neoprene, that covers a portion or most of an interior surface of the inner hollow cylinder 100.

In these embodiments, these components may be connected, coupled or attached as follows: 1) the interior hollow cylinder 100 may fit inside the outer hollow cylinder 200 and may able to retract into the outer hollow cylinder 200 or extend from the outer hollow cylinder 200 to increase the height of these embodiments. The interior hollow cylinder 100 may be connected or coupled to the outer cylinder 200 in a permanent manner. In a representative embodiment, these two cylinders 100 and 200 may be connected permanently with a track and knob system or assembly (not shown) which allows the inner hollow cylinder 100 to extend or retract (e.g., move up and down) within the outer hollow cylinder 200. In this embodiment, it is preferred that the track and knob system (not shown) has a nodule and docking station at the end and beginning of the track thus locking the two cylinders in the retracted or extended position. In some embodiments, it is also preferred to have strategic stopping points in the track to accommodate an extension of 100 to extend and insulate cans of the same circumference but varying heights such as but not limited to 16 oz or 19 oz cans.

In some embodiments, the outer hollow cylinder 200 may have insulating properties and an open top, but may have a floor at the bottom. In some embodiments, the bottom or floor may have a center hole, which is approximately ¼ inch in diameter, to allow air flow during use. In alternative embodiments, the center hole may range from $\frac{1}{8}^{th}$ to $\frac{3}{8}^{th}$ in diameter. In some embodiments, the outer hollow cylinder 200 may be made from a rigid resin or plastic with insulating properties or other materials, such as, but not limited to wood, metal, fabric, etc. In some embodiments, the outer hollow cylinder 200 will be thin, having a thickness of $\frac{1}{16}$ of an inch, or alternatively ranging from $\frac{1}{32}^{nd}$ of an inch to ¼ of an inch. In some embodiments, a circumference of the outer hollow cylinder 200 may be slightly larger than the can it's supporting or approximately $\frac{1}{32}^{nd}$ inch greater than the circumference of a standard 12 ounce beverage can thus allowing the inner cylinder 100 with insulating liner and the beverage can to fit within the outer hollow cylinder 200. Alternatively, the circumference of the outer hollow cylinder may range from $\frac{1}{32}^{nd}$ to $\frac{1}{8}^{th}$ inch greater than the circumference of the standard 12 ounce beverage can. In some embodiments, the height of the outer cylinder 200 may be such that when a standard 12 ounce beverage can rests within the insulating beverage holder device, the beverage may protrude from the insulating beverage holder device where the taper starts at the top of the beverage can, (which means approximately ½ inch to 1 inch of the top of the beverage can may be exposed). In some embodiments, the outer cylinder 200 may have a height ranging from 3.5 inches to 7 inches tall in total height.

In some embodiments, on the inside walls of the outer hollow cylinder 200 there may be two or more cut out tracks opposite of each other that are approximately $\frac{1}{16}^{th}$ inch wide and begin about ½ inch from the bottom of the outer hollow cylinder 200. In some embodiments, the cut-out tracks may start opposite of each other and may continue vertically towards a top of the outer hollow cylinder 200 stopping approximately ¼ inch from a top of the outer hollow cylinder 200. In some embodiments, there may be a knob or peg built and/or positioned on an exterior surface of the inner hollow cylinder 100 which rides in this track. In some embodiments, the knob or peg of the inner hollow cylinder 100 riding in the track of the output hollow cylinder 200 may be the basis for connection of the inner and the outer cylinder and may allow the inner cylinder 100 to extend from or retract into the outer cylinder 200. In some embodiments, to lock the inner cylinder 100 in place at the top of or a bottom of its extension or retraction, there may be a nodule built into the track. There may be many ways to connect the upper cylinder and the lower cylinder and may allow the upper cylinder 100 to extend from and retract into the outer cylinder 200, this track and nodule method may be preferred, but the insulated beverage holding device is not limited to only this structure and may encompass other techniques. In some embodiments, three tracks may provide the insulated beverage holder device with a large amount of stability.

Furthermore, the outer hollow cylinder 200 may have two "U" shaped cut-outs 205 at the top of the outer hollow cylinder 200. In some embodiments, a location of the cut-outs 205 may be approximately $\frac{1}{4}^{th}$ of the way around the outer hollow cylinder 200 past the top of the track and each "U" shaped cut out 205 may be opposite of the other "U" shaped cut-out 205. In some embodiments, the size of the cutout may be approximately 1 inch wide and 1 inch deep. In this embodiment, the purpose of the cut-out 205 is so that the user can easily grab the inner cylinder 100 when in the retracted position and pull out to extend the insulated beverage holder device into its extended position.

In some embodiments, the inner hollow cylinder may have an open top and an open bottom. In some embodiments, the inner hollow cylinder 100 may be made from a rigid resin or plastic with insulating properties or, alternatively, other materials such as, but not limited to wood, metal, foam and/or a fabric. In some embodiments, the inner hollow cylinder may be thin in thickness, preferably about $\frac{1}{16}^{th}$ of an inch thick, or alternatively may range from $\frac{1}{32}^{nd}$ to $\frac{1}{4}^{th}$ of an inch thick. In some embodiments, a circumference of the inner hollow cylinder 100 may be slightly greater than a circumference of a standard 12 ounce beverage can, but may be slightly smaller than a circumference of the outer hollow cylinder 200. In these embodiments, the circumference of the inner hollow cylinder 100 may allow the inner cylinder to fit within the outer hollow cylinder 200. In some embodiments, the inner hollow cylinder may not wiggle or otherwise be considered loose and may extend and retract with ease. Furthermore, in some embodiments, the circumference of the inner hollow cylinder 100 including its inner insulating liner may be such that a standard 12 ounce beverage vessel or can may fit within itself and may not wiggle or otherwise be considered loose. In some embodiments, a height of the inner hollow cylinder 100 will be such that when the inner hollow cylinder 100 is resting in retracted position within the outer hollow cylinder 200, the inner hollow cylinder 100 may rest upon the base floor and the height will be equal to the height of the outer hollow cylinder 200. In some embodiments, the inner hollow cylinder 100 may have two or more knobs or pegs about $1/16^{th}$ inch in size located on exterior sides of cylinder 100 approximately ½ inch from the bottom of the inner cylinder. In some embodiments, these knobs may rest within a track cut-out found on the outer hollow cylinder 200. In these embodiments, the purpose of these knobs or pegs is to position the inner hollow cylinder 100 within the outer hollow cylinder 200, allowing the inner cylinder 100 to be extended and retracted in a mechanical fashion and to lock the inner hollow cylinder 100 into a retracted or extended position with respect to the outer hollow cylinder.

In some embodiments, an outer shell may be included in the insulated beverage holder device and may be made of a material, such as but not limited to, plastic, foam, rubber, wood, metal or fabric. In some embodiments, the outer shell may be made of a rigid or plastic material able to receive customization through screen printing, molding, and/or adhesive skins, although the claimed subject matter is not limited to these techniques. In these embodiments, the outer shell is a feature which can add additional features such as but not limited to ergonomics, and/or increased insulation. The thickness of the outer shell can vary depending on desired aesthetic and insulation performance. In this example, the outer shell may slide tightly around the outer hollow cylinder 200 top and bottom leaving approximately $1/4^{th}$ inch air gap in between the outer shell and the outer hollow cylinder 200. In these embodiments, the outer shell may be attached to the outer hollow cylinder 200 utilizing glue or snaps, although the attachment may also utilize other techniques or fasteners. The outer shell adds additional functionality and benefits to the claimed subject matter, but does not hinder the basis of the claimed subject matter's core functions (i.e., claimed subject matter that relates to an extendable and retractable insulated drink holder device designed to vertically stack one or two drinking vessels or cans, such as, but not limited to, a twelve ounce beverage can.

In some embodiments, the insulated beverage holder device may include the inner liner, on the inside surface of the inner hollow cylinder 100. In these embodiments, the inner liner may be made of a material, such as but not limited to, neoprene, foam, and/or rubber. In these embodiments, the thickness of the inner liner can vary depending on desired aesthetic and insulation performance. In these embodiments, the inner liner may be attached to the inner hollow cylinder 100 by glue and/or adhesive, although other attachment techniques may be utilized. In some embodiments, the inner liner adds additional functionality and benefits to the claimed subject matter, but does not hinder the basis of the claimed subject matter's core functions and performance (e.g., an extendable and retractable insulated drink container designed to vertically stack one or two drinking vessels or cans such as, but not limited to, a twelve ounce beverage can).

Figure 7A:
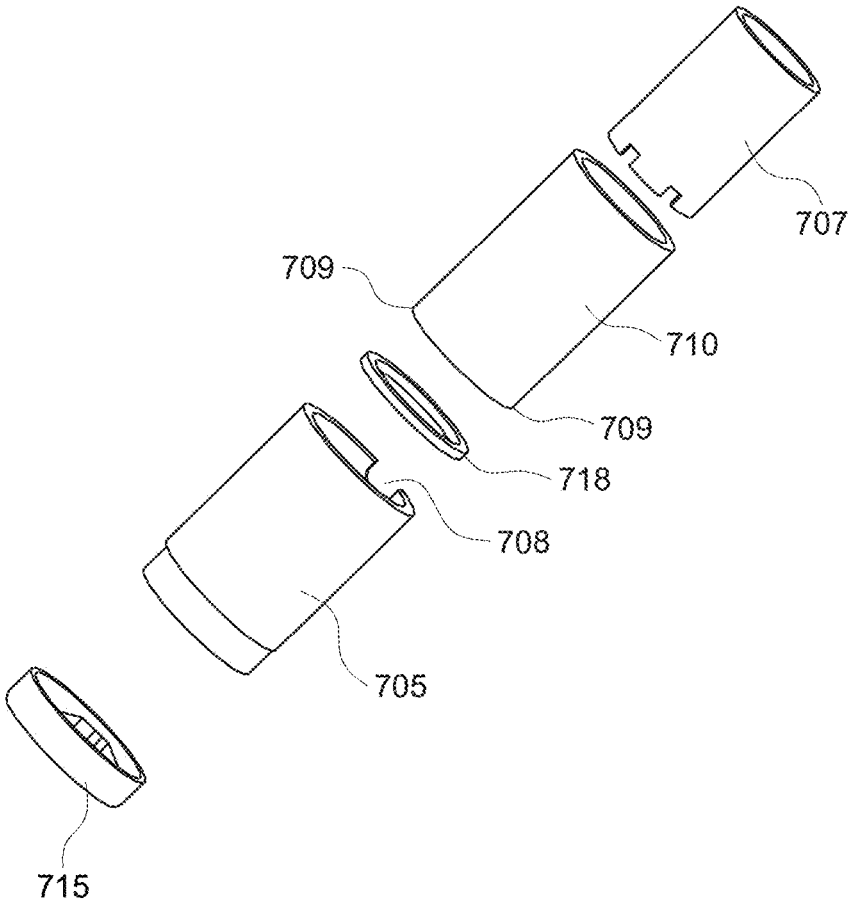
FIG. 7A illustrates an explode view of the insulated beverage holder device according to some embodiments.

FIGS. 7A-7D illustrate a second embodiment of the expandable and/or retractable insulated beverage holder device. The dimensions (e.g., heights, widths, thicknesses of different portions of the second embodiment) may be similar to those discussed above with respect to the embodiments described above with respect to FIGS. 1-6. FIG. 7A illustrates an exploded view of the insulated beverage holder device according to some embodiments. In second embodiments described herein, the insulated beverage holder device or apparatus may be made up of the following components; (1) an insulating outer hollow cylinder 705 with an open top and a floor at a bottom of the insulating outer hollow cylinder; (2) an interior insulating hollow cylinder 710 that may be positioned above or may reside inside the outer hollow cylinder 705, which has an open top and an open bottom; (3) a base plate or bottom 715 that is positioned below the outer hollow cylinder 705; and/or (4) an insulating foam cylinder or liner 707, that resides, is positioned and/or is attached to the interior insulating hollow cylinder 710, which has an open top and an open bottom. In these second embodiments, the insulating outer hollow cylinder 705 with an open top and bottom floor may be referred to as the base cylinder, the outer cylinder and/or the bottom cylinder. In these second embodiments, the interior insulating hollow cylinder 710 may be also be referred to as the upper cylinder or the inner cylinder. In some of these second embodiments, the insulated beverage holder device or apparatus 700 may include a bottom plate 715 and the floor of the bottom cylinder 705 may include holes and/or openings so that components or structure of the bottom plate 715 may pass through the openings. In alternative embodiments, the floor of the bottom cylinder 705 may include a hole for airflow and/or components or structures (e.g., fingers or protrusions) that rise from the floor of the bottom cylinder 705 on which the drinking vessel may sit. In this embodiment, the bottom plate 715 may not have components or structures that rise from its surface.

In these second embodiments, the upper cylinder 710 may move up away from and down into the lower cylinder 705. As described above, the upper cylinder 710 has openings at the top and at the bottom. When the insulated beverage holder device 700 is in single can position, configuration or mode (or in a retracted mode or position), the upper cylinder 710 may be positioned inside or mostly inside the lower or outer cylinder 705 and may extend down to near a top surface of fingers or protrusions of the base plate 715 or the lower or outer cylinder 705 (in the embodiment where the fingers or protrusions are built into the base plate 715). In these second embodiments, in the double can position or extended position, configuration and/or mode, the upper cylinder 710 may be positioned partially inside the bottom or outer cylinder 705, but the top portion of the sides of the upper cylinder 710 may extend outside of the outer cylinder 705, and thus may be exposed to the air or environment. This allows multiple beverage vessels or cans to be utilized, where the beverage vessels or cans are stacked vertically.

Figure 7B:
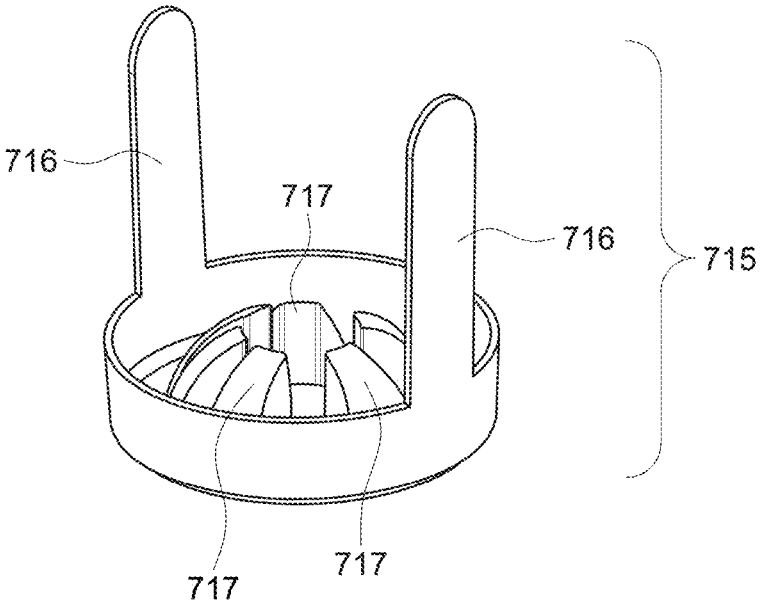
FIG. 7B illustrates a base plate having a plurality of protrusions or fingers and/or side tabs according to the second embodiments.

In some second embodiments, if an inner liner or foam cylinder is utilized, the insulated beverage holder device may further have a ring or ring assembly 718, which may be referred to as a cylinder ring. In these embodiments, the ring assembly 718 may hold the inner liner or foam cylinder 707 in place to the upper cylinder 710. In these embodiments, the ring assembly 718 may be made of a plastic, a wood, a composite and/or a metal. FIG. 7D illustrates a ring assembly that connects an inner lining to the inner or upper cylinder in some embodiments. In some embodiments, the ring assembly 718 may include more than one tabs 740 (FIG. 7D includes three tabs 740) and a ledge 741. In these embodiments, the tabs 740 of the ring 718 may be inserted and/or positioned into the openings 742 of the inner or upper cylinder 710. In some embodiments, the ledge 741 which is the inner portion or circumference of the ring assembly 718, helps support the foam cylinder 707 within the upper cylinder 710.

In these second embodiments, the upper cylinder 710 may be attached to the bottom cylinder 705. In these second embodiments, the upper cylinder 710 may not be detachable from the bottom or base cylinder 705. In these second embodiments, the attachment or connection may be made by a pin and/or peg. In some of these second embodiments, the upper cylinder 710 may include two or more tabs 739 and/or associated pins or pegs 709. In some embodiments, the tabs 739 may be cut into the upper cylinder (as shown in FIG. 7D). In some embodiments, the pins or pegs 709 may be circular or oval and may be on an outside surface of the one or more tabs 739 (and thus the upper cylinder). In these second embodiments, three pins or pegs 709 may be utilized to provide for stabilization. In these second embodiments, the tabs 739 may be utilized due to a draft angle in the bottom cylinder 705 (which is needed to assist in holding the can or beverage vessel). In these second embodiments, the tabs 739 may need this flexibility because of a draft angle of the bottom cylinder 705 in order to hold the upper cylinder 710 in place when moving up and down.

Figure 7C:
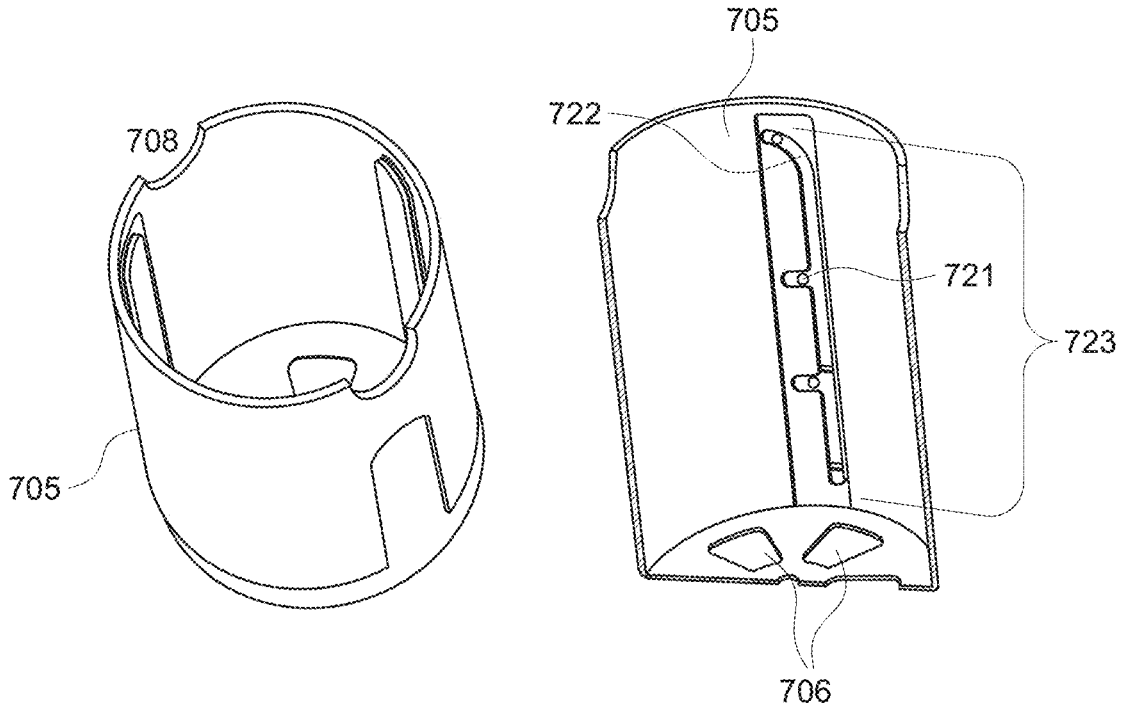
FIG. 7C illustrates a cross-section cut away view and an upper perspective view of the lower or outer cylinder 705 according to some embodiments.
Figure 7D:
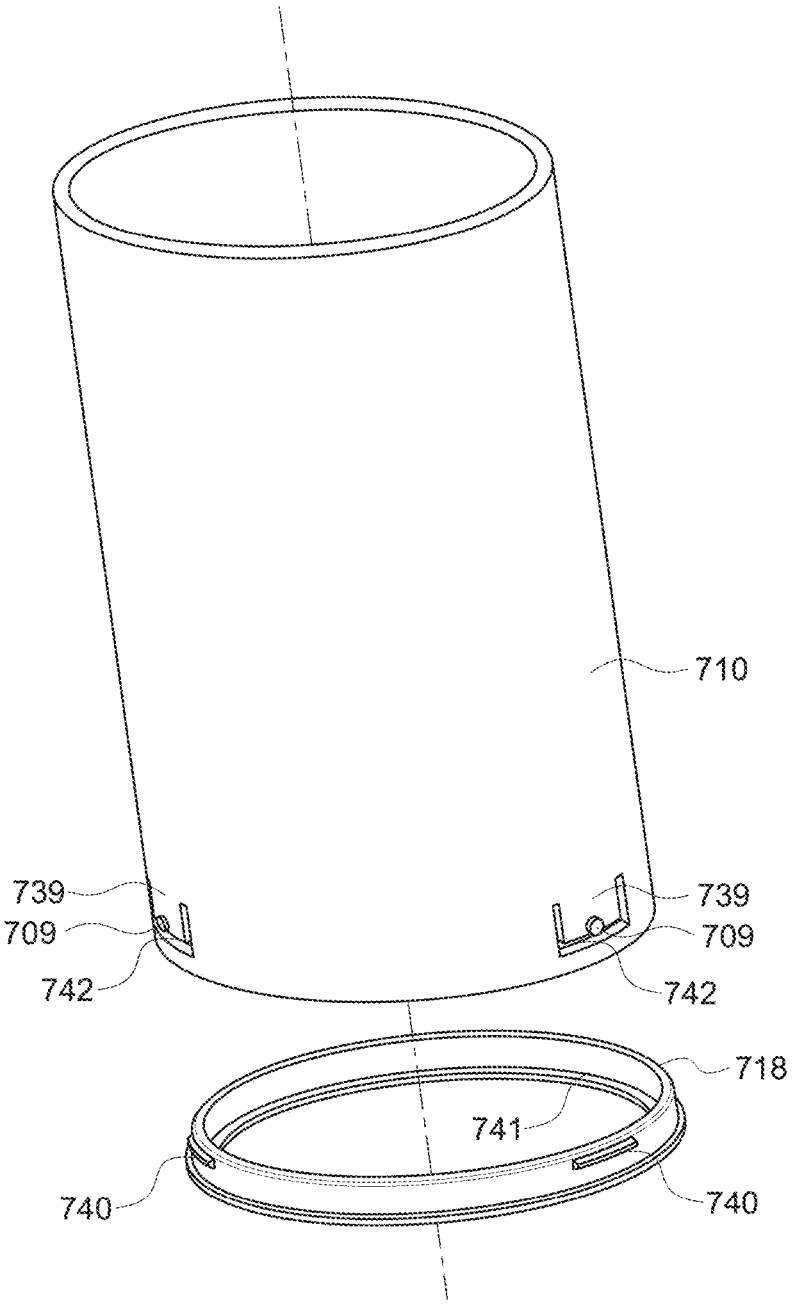
FIG. 7D illustrates a ring assembly that connects an inner lining to the inner or upper cylinder in some embodiments.

FIG. 7C illustrates a cross-section cut away view and an upper perspective view of the lower or outer cylinder 705 according to some embodiments. In these second embodiments, the bottom or base cylinder 705 may include two or more halfmoon notches 708 along a side of the bottom or base cylinder. In some embodiments, the two or more notches 708 allow for the user's fingers to grip the inner or upper cylinder to allow for the user to extend the upper cylinder 710 to an extended or open position. In these second embodiments, the base or bottom cylinder 705 may include two or more tracks 722. In some embodiments, the two or more tracks 722 may be positioned and/or built into an inside side wall of the base or lower cylinder 705 (three tracks are illustrated in FIG. 7C). In some of the second embodiments, the two or more tracks 722 may be attached and/or coordinated with the two or more pins or pegs of the upper cylinder 710 to allow the upper cylinder 710 and the base cylinder 705 to interact with each other (e.g., the upper cylinder to move up or down with respect to the base cylinder). In these second embodiments, the two or more tracks 722 may have a vertical height slightly less than the height of the base cylinder 705 (or alternatively from the top of the sidewall of the base cylinder 705 to a height of below the protrusions or fingers that arise from the base plate 715). This also allows the upper cylinder 710 to move up and down with respect to the base or bottom cylinder 705. In addition, the tracks 722 may also include extra support material 723 to provide further stabilization. The extra material 723 around the track is built with a taper from top to bottom opposite the taper created in the base cylinder wall due to the draft angle. The taper in the extra material 723 offsets the draft angle in the base wall to create a consistent vertical surface for the track area. In these second embodiments, the vertical tracks may have no more than a 0 to 5 degree lateral angle change from top to bottom of the track or alternatively stated the tracks vertical angle should range from 85 degrees to 90 degrees from top to bottom. If the angle is larger, then the insulated beverage holder device may not release during a manufacturing process. In some embodiments extra material 723 may be added around the track to create a 0 to 5 degree angle from the top to bottom opposite the degree of draft angle in the bottom cylinder 705. In some second embodiments, the two or more tracks 722 may also include detents 721, slight offsets or twists that may be positioned at different levels in order to correspond to different levels of beverage vessel or can stacking. In other words, the two or more tracks 722 of the outer or lower cylinder 705 may have a detent 721 or stopping track points at standard 12 ounce cans and may have another detent 721 or stopping track points at unique 16 or 19 ounce can designs.

In these second embodiments, the foam cylinder or liner 707 may be installed inside the upper cylinder 710. In some embodiments, the foam cylinder or liner 707 may be attached, connected and/or adhered to the upper cylinder 710 so that they appear to be one unitary piece.

In some second embodiments, the bottom cylinder floor may comprise a plurality of openings (e.g., five are illustrated in FIG. 7C) and the base plate 715 may comprise an associated plurality of fingers, extensions or protrusions 717 that rise from the base plate 715 bottom surface. FIG. 7B illustrates a base plate having a plurality of protrusions or fingers and/or side tabs according to the second embodiments. The use of the fingers, extensions and/or protrusions 717 provides extra stability for the insulated beverage holder or device so that a drink vessel sitting within the bottom cylinder 705 does not move much laterally during use. In some second embodiments, the beverage vessel (e.g., a bottom of the beverage vessel) may rest or be positioned on top surfaces of the plurality of fingers, extensions, or protrusions 717. In some second embodiments, this may also allow the top cylinder 710 to slide down past the bottom cylinder and/or may also allow for height to be built into the upper cylinder 710 and/or the bottom cylinder 705. For example, in these second embodiments, this may be advantageous because the inner cylinder or upper cylinder may be extended to go farther up a can or beverage vessel when extending. In these second embodiments, this design may also be advantageous because it allows the height of the beverage vessel or can to rise above the upper cylinder when the insulated beverage holder device is in single can configuration while still achieving desired height of inner cylinder when extended for stacking two beverage vessels. In an alternative embodiment, the bottom or outer cylinder 705 floor may have a small circular opening to allow for air flow. In an alternative embodiment, the floor of the bottom or outer cylinder 705 may have a plurality of fingers, extensions and/or protrusions rising therefrom, that may be utilized so that a beverage container may rest on tops of the fingers, extensions and/or protrusions. In this alternative embodiment, the base plate 715 may not have fingers, extensions and/or protrusions. In this alternative embodiment, the base plate 715 may fit around the bottom or outer cylinder 705 and include sides above a bottom floor of the bottom or outer cylinder 705.

In some embodiments, the base plate 715 may also include one or more side tabs 716 that also provide stability for the beverage vessel or can as well as the upper cylinder 710 when the insulated beverage holder is in single can configuration or mode (two side tabs are shown in FIG. 7B). In these second embodiments, the two side tabs 716 are outside the bottom or outer cylinder 705 (e.g., the bottom or outer cylinder 705 fits inside the two side tabs 716). In these second embodiments, the base plate 715 including the two extending side tabs 716 may also provide a tacky and/or rubbery grip for user's hands and on the bottom of the insulated beverage holder device so that the insulated beverage holder does not slide around on surfaces.

Different features, variations and multiple different embodiments have been shown and described with various details. What has been described in this application at times in terms of specific embodiments is done for illustrative purposes only and without the intent to limit or suggest that what has been conceived is only one particular embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

A person of ordinary skill in the art will recognize that any process or method disclosed herein can be modified in many ways. The process parameters and sequence of the steps described and/or illustrated herein are given by way of example only and can be varied as desired. For example, while the steps illustrated and/or described herein may be shown or discussed in a particular order, these steps do not necessarily need to be performed in the order illustrated or discussed.

The various exemplary methods described and/or illustrated herein may also omit one or more of the steps described or illustrated herein or comprise additional steps in addition to those disclosed. Further, a step of any method as disclosed herein can be combined with any one or more steps of any other method as disclosed herein.

Unless otherwise noted, the terms "connected to" and "coupled to" (and their derivatives), as used in the specification and claims, are to be construed as permitting both direct and indirect (i.e., via other elements or components) connection. In addition, the terms "a" or "an," as used in the specification and claims, are to be construed as meaning "at least one of." Finally, for ease of use, the terms "including" and "having" (and their derivatives), as used in the specification and claims, are interchangeable with and shall have the same meaning as the word "comprising.

As used herein, the term "or" is used inclusively to refer items in the alternative and in combination.

As used herein, characters such as numerals refer to like elements.

Embodiments of the present disclosure have been shown and described as set forth herein and are provided by way of example only. One of ordinary skill in the art will recognize numerous adaptations, changes, variations and substitutions without departing from the scope of the present disclosure. Several alternatives and combinations of the embodiments disclosed herein may be utilized without departing from the scope of the present disclosure and the inventions disclosed herein. Therefore, the scope of the presently disclosed inventions shall be defined solely by the scope of the appended claims and the equivalents thereof.

The invention claimed is:

1. An insulated beverage holder device, comprising:

an insulated outer hollow cylinder, the insulated outer hollow cylinder including an open top and a bottom floor;

an interior insulating hollow cylinder, the interior insulating hollow cylinder having an open top and an open bottom, the interior insulating hollow cylinder configured to be positioned inside the insulated outer hollow cylinder and attached to the insulated outer hollow cylinder;

an insulating hollow liner, the insulating hollow liner having an open top and an open bottom, the insulating hollow liner attached to the interior insulating hollow cylinder and the insulating hollow liner configured to touch a first beverage container; and a base plate, the base plate positioned below the insulated outer hollow cylinder and connected to the insulated outer hollow cylinder, wherein the base plate includes two or more fingers or protrusions extending upwards from a bottom surface of the base plate.

2. The insulated beverage holder device of claim 1, wherein the bottom floor of the insulated outer hollow cylinder includes two or more openings, each respective opening of the two or more openings allowing each finger or protrusion of the two or more fingers or protrusions to pass through the respective opening, wherein the two or more fingers or protrusions are configured to provide support to the first beverage container.

3. The insulated beverage holder device of claim 1, wherein the two or more fingers or protrusions are configured to provide support to the first beverage container.

4. The insulated beverage holder device of claim 1, further comprising a ring assembly, the ring assembly to connecting the interior insulating hollow cylinder to the insulating hollow liner.

5. The insulating beverage holder device of claim 4, wherein the ring assembly includes one or more tabs that are connected to corresponding openings in the interior insulating hollow cylinder and a ledge, a bottom circumference insulating hollow liner positioned into the ledge.

6. The insulating beverage holder device of claim 1, wherein the insulated outer hollow outer cylinder has a draft angle of between 0 to 5 degrees from the bottom floor to the open top for ease of manufacturing.

7. The insulating beverage container of claim 1, wherein the base plate includes two or more side tabs and the insulated outer hollow cylinder includes two or more depressions into which the two or more side tabs may be positioned.

8. The insulating beverage container of claim 1, wherein the insulated outer hollow cylinder includes two u-shaped openings on a top portion of the insulated outer hollow cylinder, the two u-shaped openings allow a consumer to grip the first beverage container.

9. An insulated beverage holder device, comprising:

an insulated outer hollow cylinder, the insulated outer hollow cylinder including an open top and a bottom floor;

an interior insulating hollow cylinder, the interior insulating hollow cylinder having an open top and an open bottom, the interior insulating hollow cylinder configured to be positioned inside the insulated outer hollow cylinder and attached to the insulated outer hollow cylinder;

an insulating hollow liner, the insulating hollow liner having an open top and an open bottom, the insulating hollow liner attached to the interior insulating hollow cylinder and the insulating hollow liner configured to touch a first beverage container; and a base plate, the base plate positioned below the insulated outer hollow cylinder and connected to the insulated outer hollow cylinder, wherein the insulated outer hollow outer cylinder has a draft angle of between 0 to 5 degrees from the bottom floor to the open top for ease of manufacturing; and wherein the interior insulating hollow cylinder moves upward from a position substantially inside the insulated outer hollow cylinder to a position substantially above the insulated outer hollow cylinder to allow for insulation of the first beverage container and a second beverage container.

10. The insulating beverage holder device of claim 9, wherein the interior insulating hollow cylinder includes two or more tabs and associated circular pegs to assist in connecting to the insulated outer hollow cylinder.

11. The insulating beverage holder device of claim 10, wherein the insulated outer hollow cylinder includes two or more tracks on an interior surface of the insulated outer hollow cylinder, the two or more circular pegs to move up and down the two or more tracks to move the interior insulating hollow cylinder from a retracted position to an extended position.

12. The insulating beverage holder device of claim 11, wherein the two or more tracks include extra material built around the two or more tracks such that the extra material tapers from narrower at a bottom part of the two or more tracks to thicker at an upper part of the two or more tracks, the extra material to reduce the draft angle in the insulated outer hollow cylinder.

13. The insulating beverage holder device of claim 11, wherein the two or more tracks has two or more associated detents and stopping track points or ledges to correspond to different height sizes of the first beverage container.

* * * * *